US011187479B2

(12) United States Patent
Barton et al.

(10) Patent No.: US 11,187,479 B2
(45) Date of Patent: Nov. 30, 2021

(54) FIREARM AND COMPONENTS THEREFOR

(71) Applicants: Wendy Lynn Barton, Calgary (CA); Jeremy Allen Elrod, Reno, NV (US)

(72) Inventors: Wendy Lynn Barton, Calgary (CA); Jeremy Allen Elrod, Reno, NV (US)

( * ) Notice: Subject to any disclaimer, the term of this patent is extended or adjusted under 35 U.S.C. 154(b) by 57 days.

(21) Appl. No.: 16/315,145

(22) PCT Filed: Jul. 7, 2017

(86) PCT No.: PCT/US2017/041121
§ 371 (c)(1),
(2) Date: Jan. 3, 2019

(87) PCT Pub. No.: WO2018/009813
PCT Pub. Date: Jan. 11, 2018

(65) Prior Publication Data

US 2019/0310037 A1 Oct. 10, 2019

Related U.S. Application Data

(60) Provisional application No. 62/359,619, filed on Jul. 7, 2016.

(51) Int. Cl.

| | |
|---|---|
| ***F41A 5/28*** | (2006.01) |
| ***F41A 9/38*** | (2006.01) |
| ***F41A 11/00*** | (2006.01) |
| ***F41A 5/26*** | (2006.01) |
| ***F41A 5/18*** | (2006.01) |

(52) U.S. Cl.
CPC ..... *F41A 5/28* (2013.01); *F41A 5/18* (2013.01); *F41A 5/26* (2013.01); *F41A 9/38* (2013.01); *F41A 11/00* (2013.01)

(58) Field of Classification Search
CPC ..... F41A 5/28; F41A 5/18; F41A 5/26; F41A 9/38; F41A 11/00
USPC ..... 89/193
See application file for complete search history.

(56) References Cited

U.S. PATENT DOCUMENTS

| | | | | |
|---|---|---|---|---|
| 2,865,256 | A * | 12/1958 | Marsh | F41A 5/30 89/191.02 |
| 3,346,984 | A * | 10/1967 | Lohr | F41A 1/04 42/55 |
| 2010/0218671 | A1* | 9/2010 | Mayberry | F41A 5/28 89/192 |
| 2011/0173864 | A1* | 7/2011 | Christensen | F41A 21/04 42/78 |
| 2012/0079935 | A1* | 4/2012 | Herring | F41A 5/18 89/193 |
| 2012/0152104 | A1* | 6/2012 | Audibert | F41A 5/18 89/191.01 |
| 2012/0167756 | A1* | 7/2012 | Larue | F41A 21/28 89/193 |
| 2014/0230297 | A1* | 8/2014 | Larson, Jr. | F41A 19/10 42/6 |
| 2014/0305297 | A1* | 10/2014 | Hall | F41A 5/26 89/193 |

(Continued)

OTHER PUBLICATIONS

PCT International Search Report and Written Opinion, Application No. PCT/US2017/041121, dated Sep. 15, 2017, 12 pages.

*Primary Examiner* — Joshua E Freeman
(74) *Attorney, Agent, or Firm* — VLP Law Group LLP

(57) ABSTRACT

Embodiments of the disclosure relate to semi-automatic, automatic, and bolt-action firearms and components for such firearms.

20 Claims, 14 Drawing Sheets

(56) References Cited

U.S. PATENT DOCUMENTS

| | | | | |
|---|---|---|---|---|
| 2015/0135942 | A1* | 5/2015 | Gomez | F41A 19/06 89/191.01 |
| 2015/0267979 | A1* | 9/2015 | Miller | F41A 9/61 89/191.01 |
| 2015/0323268 | A1* | 11/2015 | Kokinis | F41A 11/02 89/193 |
| 2016/0161200 | A1* | 6/2016 | Windauer | F41A 5/28 89/193 |
| 2016/0202012 | A1* | 7/2016 | Kokinis | F41A 5/26 89/193 |

* cited by examiner

FIREARM AND COMPONENTS THEREFOR

PRIORITY CLAIM

This application is a national stage entry of International Patent Application Ser. No. PCT/US2017/041121, filed Jul. 7, 2017, which published as PCT Publication No. WO2018/009813 on Jan. 11, 2018, which claims the benefit of U.S. Provisional Patent Application Ser. No. 62/359,619, filed Jul. 7, 2016, for "Firearm and Components Therefor" the disclosure of each of which is hereby incorporated herein in its entirety by this reference.

TECHNICAL FIELD

Embodiments of the disclosure relate to semi-automatic, automatic, and bolt-action firearms and components for such firearms.

BACKGROUND

High pressures (e.g., more than 50,000 psi (344.7379 mpa)) generated upon firing long-range ammunition can be difficult to manage in firearms for proper cycling (i.e., firing the ammunition, removing a case of the ammunition from the firing chamber, loading new ammunition into the firing chamber, and preparing to file the new ammunition) without malfunctions or unduly wearing or even destroying components of the firearms. The components of the firearms (e.g., rifles) for firing such long-range ammunition are often formed of a heavy steel material to withstand the high pressures. Due to the high pressures resulting from firing the ammunition, a projectile travels through a barrel of the firearm to exit the barrel at speeds of over 2,500 ft/s. The time from firing the ammunition to the projectile exiting the barrel is a small fraction of a second, on the order of thousandths of a second.

In gas-operated firearms, pressure generated by the firing of the ammunition is used to perform the cycling operation. A gas port is located in the barrel to communicate the pressure to a bolt that is used to extract the spent ammunition case, eject the case, and reload ammunition into the firing chamber. The time the projectile is in the barrel after passing the gas port is referred to as "dwell time." A sufficient dwell time is required to enable the pressure to act through the gas port on the bolt to result in cycling. If there is too much dwell time, the projectile is slowed within the barrel, or the barrel may move based on the action of the bolt and other components, resulting in reduced accuracy. There is a desire in the art for firearms that fire with improved accuracy and consistency, that cycle reliably, and that are light-weight.

MODE(S) FOR CARRYING OUT THE INVENTION

Figure 1:
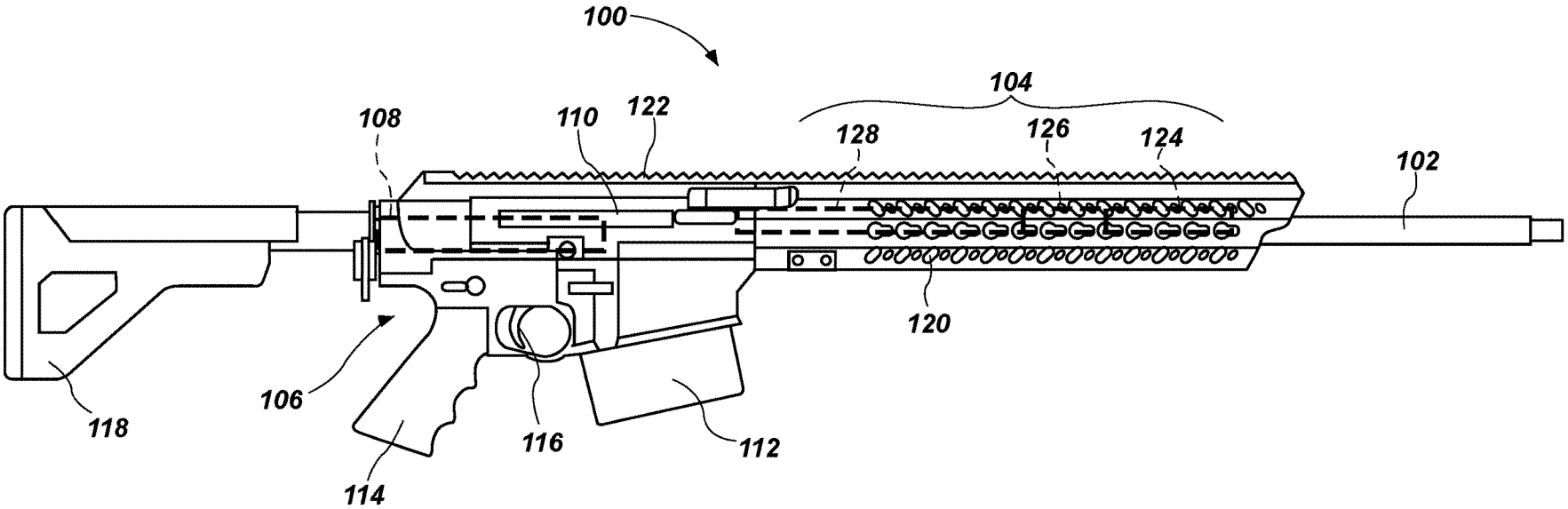
FIG. 1 shows a firearm according to an embodiment of the present disclosure.

The following description provides specific details, such as material types, manufacturing processes, uses, and structures in order to provide a thorough description of embodiments of the present disclosure. However, a person of ordinary skill in the art will understand that the embodiments of the present disclosure may be practiced without employing these specific details. Indeed, the embodiments of the present disclosure may be practiced in conjunction with conventional manufacturing techniques and materials employed in the industry.

In the following detailed description, reference is made to the accompanying drawings, which form a part hereof, and in which is shown, by way of illustration, specific embodiments in which the present disclosure may be practiced. These embodiments are described in sufficient detail to enable a person of ordinary skill in the art to practice the present disclosure. However, other embodiments may be utilized, and structural, material, dimensional, and other changes may be made without departing from the scope of the disclosure. The illustrations presented herein are not meant to be actual views of any particular system, device, structure, or process, but are idealized representations that are employed to describe the embodiments of the present disclosure. The drawings presented herein are not necessarily drawn to scale. Similar structures or components in the various drawings may retain the same or similar numbering for the convenience of the reader; however, the similarity in numbering does not mean that the structures or components are necessarily identical in size, composition, configuration, or other property.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, any relational term, such as "first," "second," "over," "top," "bottom," "upper," "lower," "front," "back," etc., is used for clarity, consistency of terminology, and convenience in understanding the disclosure and accompanying drawings and does not connote or depend on any specific preference, orientation, or order, except where the context clearly indicates otherwise. For example "front" and "back" are generally used with reference to a position and orientation of a firearm and its components when the muzzle is considered at a front of the firearm and a stock is considered at a back of the firearm.

The embodiments of the present disclosure include firearms and components for firearms. The firearms of the present disclosure may be sufficiently robust to repeatedly withstand pressures of at least 50,000 psi (344.7379 mpa) upon firing of ammunition, while maintaining a low weight (e.g., less than about 15 pounds (6.8 kg) excluding ammunition and accessories such as optical scopes). The firearms of the present disclosure may be configured for reliable cycling by positioning a gas port in a location that is selected to provide sufficient dwell time for actuating a gas management system without inhibiting accuracy due to movement of the barrel while a projectile is within the barrel. A bolt assembly may be configured for reliable extraction and ejection of a case without damaging the case due to extraction or ejection. Additional features and embodiments of the firearms and components of the present disclosure are described below.

FIG. 1 shows a firearm 100 according to an embodiment of the present disclosure. The firearm 100 includes a barrel 102, a gas management system 104, a receiver and buffer tube assembly 106, a bolt assembly 108, a case ejection port 110, a grip 114, a trigger 116, and a stock 118. The firearm may also include a handguard 120, a rail 122 for attaching one or more additional accessories (e.g., sights, an optical scope) to the firearm 100, and a magazine 112 for housing and feeding ammunition into the firearm 100.

The gas management system 104, which may be a so-called "short stroke piston" gas management system 104, may include a gas block 124 coupled to the barrel 102, a gas piston 126 slidably coupled to the gas block 124, and an operation rod 128 operably coupled to the gas piston 126 at a front end of the operation rod 128. A back end of the operation rod 128 may be coupled to the receiver and buffer tube assembly 106 for transferring energy from the gas piston 126 to the bolt assembly 108. The operation rod 128 may be biased forward toward the gas piston 126, such as by a spring (which may be a spring in or associated with the bolt assembly 108), to return the operation rod 128 and gas piston 126 to an initial position at a conclusion of a firing cycle. Such a short stroke piston gas management system 104 is configured to push the bolt assembly 108 with the operation rod 128 to drive the bolt assembly 108 through a full cycle, but the operation rod 128 is not rigidly coupled to the bolt assembly 108 and moves a shorter distance than the bolt assembly 108.

Although the gas management system 104 is described herein, by way of example, as a short stroke piston gas management system 104, the present disclosure is not so limited. For example, embodiments of the present disclosure also include so-called "long-stroke piston" and "direct impingement" gas management systems, as are known to those of ordinary skill in the art.

Figure 2A:
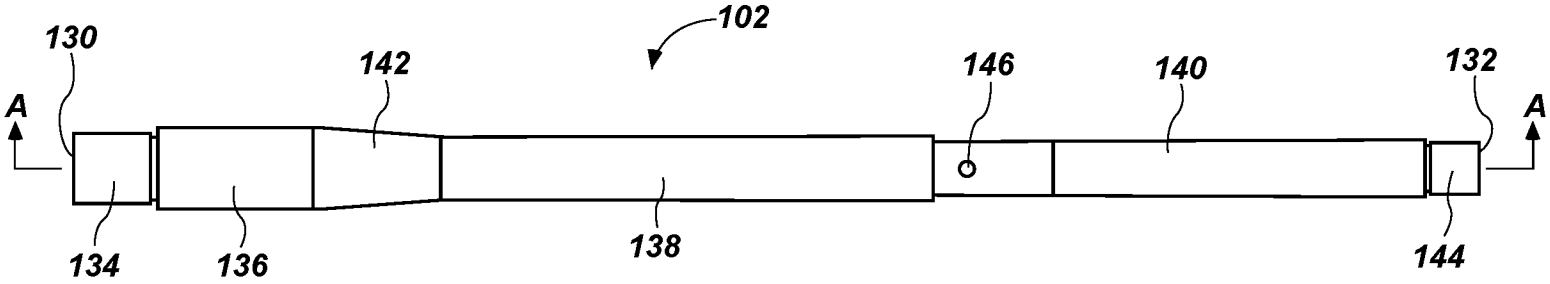
FIG. 2A shows a top view of a barrel of the firearm of FIG. 1 according to an embodiment of the present disclosure.
Figure 2B:
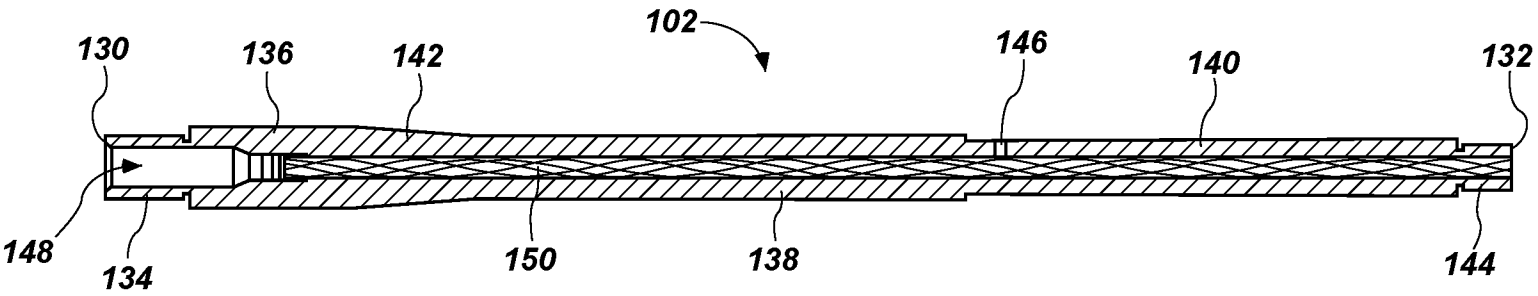
FIG. 2B shows a cross-sectional view of the barrel of FIG. 2A.

FIG. 2A shows a top view of the barrel 102 of the firearm 100 of FIG. 1 according to an embodiment of the present disclosure. FIG. 2B shows a cross-sectional view of the barrel of FIG. 2A. The barrel 102 includes a back end surface 130, a front end surface 132, a back threaded portion 134 proximate the back end surface 130, a back barrel portion 136, a middle barrel portion 138, and a front barrel portion 140. The barrel 102 may have any external contour. For example the back barrel portion 136 may be larger in outer diameter than the middle barrel portion 138, and a tapered barrel portion 142 may extend from the back barrel portion 136 to the middle barrel portion 138. The middle barrel portion 138, in turn, may be larger in outer diameter than the front barrel portion 140. A front threaded portion 144 may be proximate the front end surface 132, such as for connecting a muzzle brake or suppressor to a front end of the barrel 102.

A gas port 146 may extend across a thickness of a wall (e.g., a top wall) of the barrel 102 to enable flow of a pressurized gas from inside the barrel 102 to an outside of the barrel 102 during firing. The gas port 146 may be sized and shaped to provide an appropriate flow and pressure through the gas port 146 for cycling the firearm 100 (FIG. 1). By way of example and not limitation, the gas port 146 may have a substantially circular cross-section, and may have a diameter of 0.070 inch±0.010 inch (1.778 mm±0.254 mm).

The barrel 102 may also include a firing chamber 148 proximate the back end surface 130 sized and shaped for receiving ammunition (e.g., a bullet) therein for firing. An interior surface of the barrel 102 from the firing chamber 148 to the front end surface 132 may include rifling 150, which is spiral grooves and/or ridges provided to spin a projectile as it passes through the barrel 102, for improved accuracy.

The gas port 146 may be positioned at a location along the barrel 102 that is selected to provide sufficient pressure for cycling the firearm 100 (FIG. 1), without providing excess pressure that could damage components of the firearm 100 or negatively affect timing of the cycling operations (which may result in malfunction of the firearm 100, such as failing to load a new bullet into the firing chamber 148 or failing to properly extract and eject a spent case). In addition, the gas port 146 may be positioned at a location that provides sufficient dwell time (i.e., time that the projectile is within the barrel 102 and passing between the gas port 146 and the front end surface 132, which is time that pressurized gas is forced through the gas port 146), but not so much dwell time that movement of components during cycling moves the barrel 102 to negatively affect accuracy.

Figure 3:
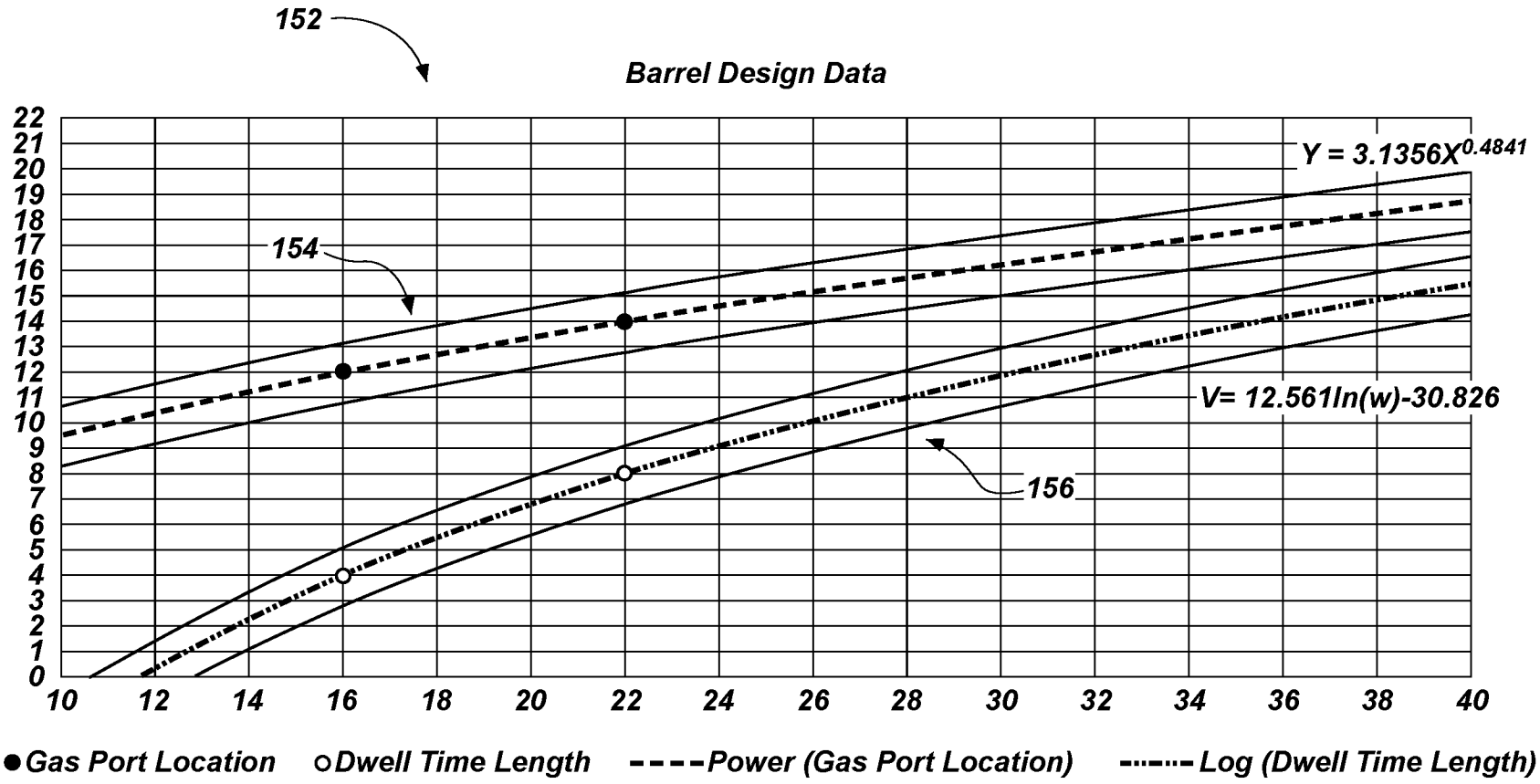
FIG. 3 is a plot of barrel length on a horizontal axis, and a position of a gas port on the barrel relative to a back surface of the barrel and a distance between the gas port and a front surface of the barrel on a vertical axis.

Referring to FIG. 3 in conjunction with FIGS. 2A and 2B, FIG. 3 shows a plot 152 showing a length of the barrel 102 along a horizontal x-axis and, along a vertical y-axis, a position of the gas port 146 on the barrel 102 relative to the back end surface 130 of the barrel, and a distance (i.e., dwell time length) between the gas port 146 and the front end surface 132 of the barrel 102. For a range of barrel 102 lengths x between about 14 inches (35.56 cm) and about 22 inches (55.88 cm), an appropriate position y of the gas port 146, as measured from the back end surface 130 of the barrel 102, may follow a first curve 154 defined by the following Equation 1: $y=3.135*x^{0.4841}\pm1.0$. In some embodiments, barrels 102 having a length x of between about 14 inches (35.56 cm) and about 18 inches (45.72 cm) include a gas port 146 positioned according to Equation 1. Conversely, a dwell time length v (i.e., a length between the gas port 146 and the front end surface 132) for barrel 102 lengths w between about 14 inches (35.56 cm) and about 22 inches (55.88 cm) may follow a second curve 156 defined by the following Equation 2: $v=12.561*\ln(w)-30.826\pm1.0$. In some embodiments, a barrel 102 having a length w of between about 14 inches (35.56 cm) and about 18 inches (45.72 cm) includes a gas port 146 positioned according to Equation 2. By way of example and not limitation, a barrel 102 having a length of 16 inches (40.64 cm) may include a gas port 146 that is located at about 12 inches (30.48 cm) from the back end surface 130 of the barrel 102, and that is located at about 4 inches (10.16 cm) from the front end surface 132 of the barrel 102. By way of another example, a barrel 102 having a length of 18 inches (45.72 cm) may include a gas port 146 that is located at about 12.7 inches (32.258 cm) from the back end surface 130, and that is located at about 5.3 inches (13.462 cm) from the front end surface 132.

Figure 4:
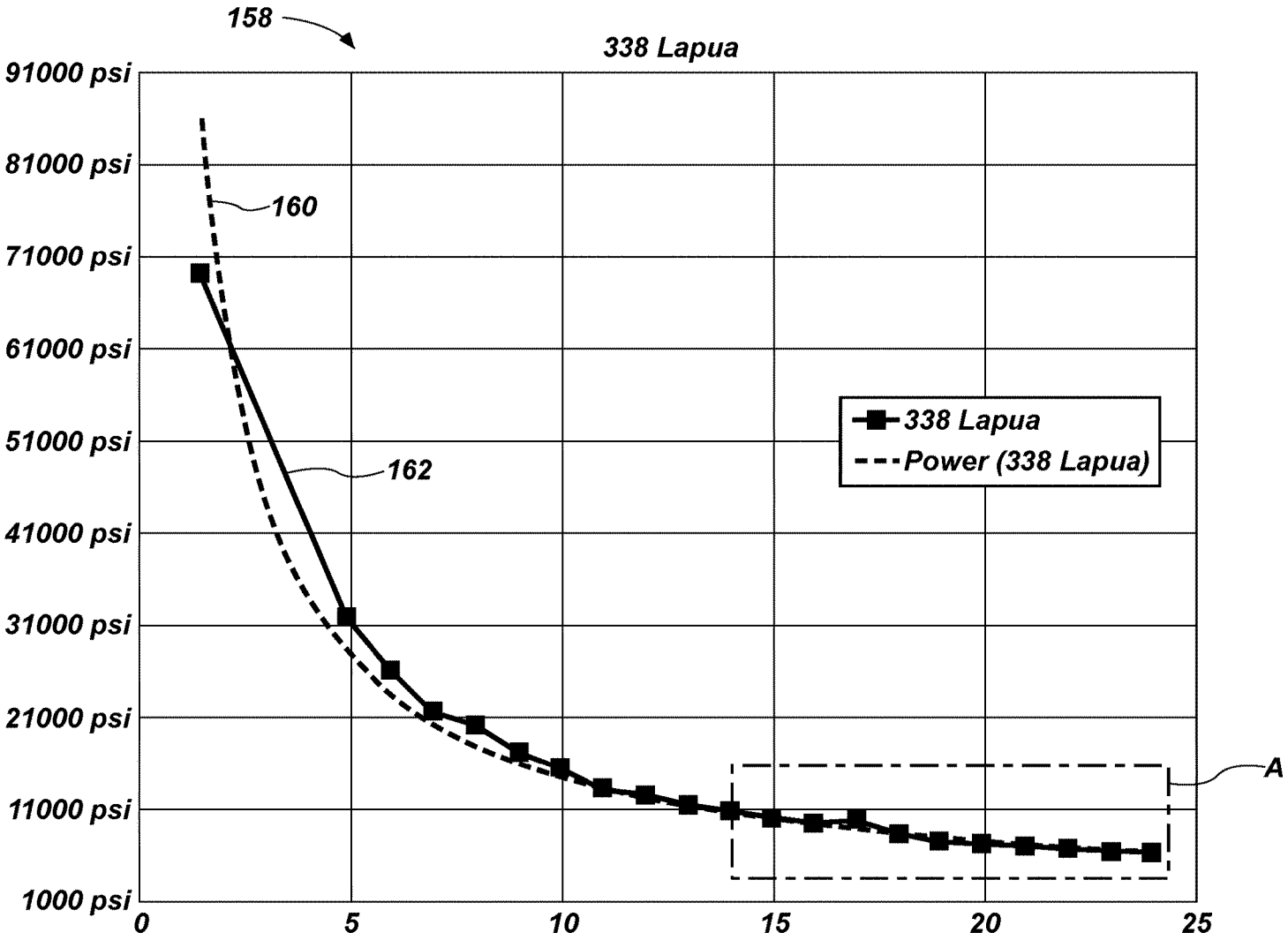
FIG. 4 is a plot showing theoretical and actual pressure generated by a .338 LAPUA® Magnum bullet and acting on a projectile along a length of a barrel.

Referring to FIG. 4 in conjunction with FIGS. 2A and 2B, FIG. 4 is a plot 158 showing a theoretical pressure 160 and an actual (measured) pressure 162 generated by a .338 LAPUA® Magnum bullet ("338 LM bullet") and acting on a projectile of the 338 LM bullet along a length of the barrel 102. Initially, upon firing of the 338 LM bullet, an initial maximum pressure of about 69,000 psi (475.7383 mpa) is observed due to combustion of gun powder within the 338 LM bullet case. Loading (e.g., amount of gun powder, size of gun powder grains) of the bullet and environmental factors (e.g., temperature, pressure, humidity), for example, affect the actual maximum pressure of a particular firing. As the projectile travels through the barrel 102 and a volume behind projectile increases in size, the pressure behind the projectile decreases.

Figure 5:
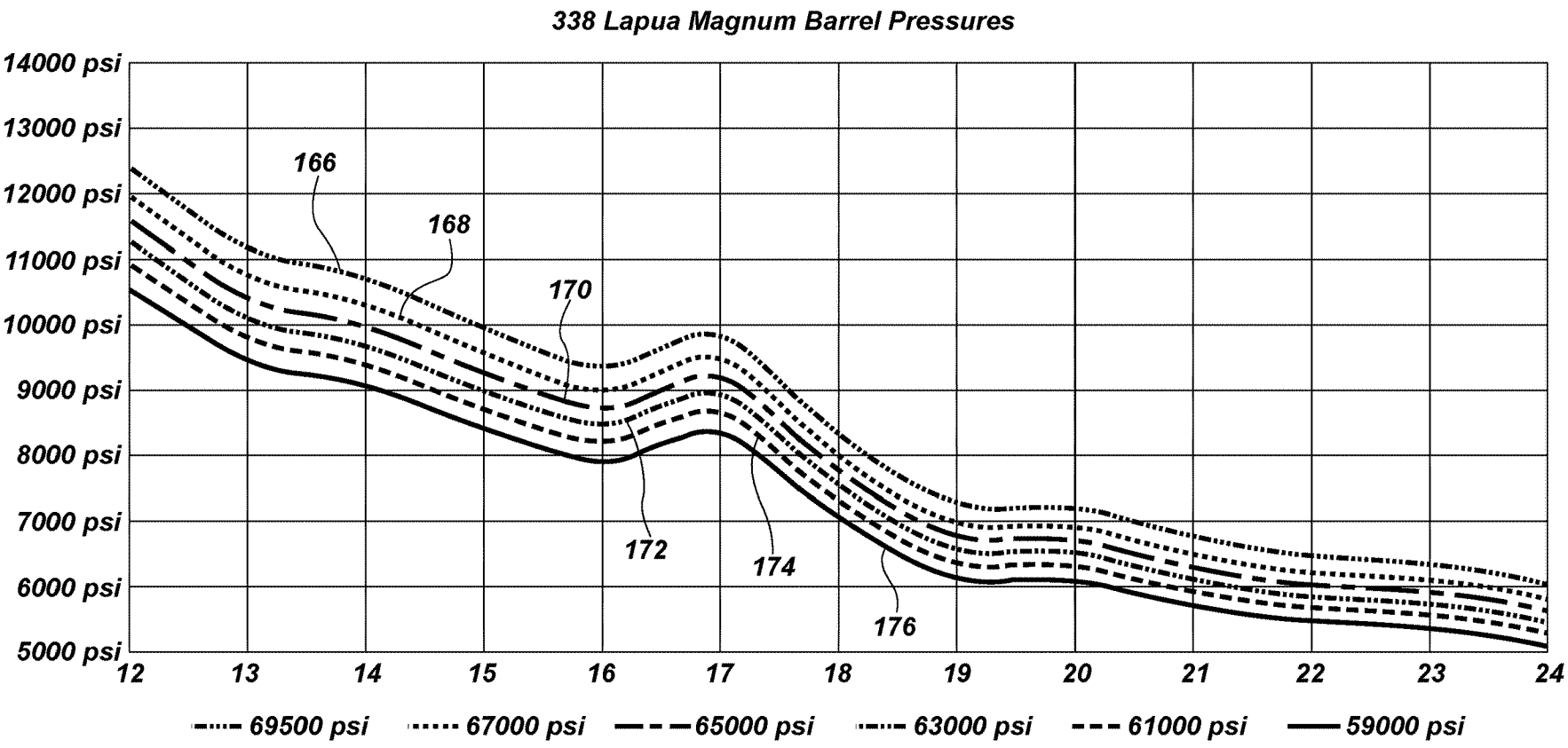
FIG. 5 is a plot showing pressures generated by .388 LAPUA® Magnum bullets having various maximum pressures, along a certain length of a barrel.

FIG. 5 is a plot showing pressures 166, 168, 170, 172, 174, 176 generated by 338 LM bullets exhibiting various maximum pressures (i.e., respectively about 69,500 psi (479.1856 mpa), about 67,000 psi (461.9487 mpa), about 65,000 psi (448.1592 mpa), about 63,000 psi (434.3697 mpa), about 61,000 psi (420.5802 mpa), and about 59,000 psi (406.7907 mpa), from top to bottom of FIG. 5) along a certain length of the barrel 102 (FIGS. 2A and 2B) shown by dashed box A in FIG. 4. It has been observed that the pressure profiles of such different 338 LM bullets of differing maximum pressures are relatively close to each other at least in a range of about 12 inches (30.48 cm) to about 24 inches (60.96 cm) of barrel 102 location. Even though the initial maximum firing pressure of the various 338 LM bullets varies by more than 10,000 psi (68.9476 mpa), the pressures observed in the barrel 102 at any location between about 12 inches (30.48 cm) and about 24 inches (60.96 cm) only various by about 2,000 psi (13.7895 mpa) or less, and the pressure range between the various 338 LM bullets becomes substantially smaller as the barrel 102 location increases. Thus, the location of the gas port 146 may effectively be positioned in the range of about 12 inches (30.48 cm) to about 24 inches (60.96 cm) from the back end surface 132 of the barrel 102 (see FIGS. 2A and 2B) and still effectively function with bullets having a wide range of initial maximum pressures. Accordingly, by positioning of the gas port 146 as described above with reference to Equations 1 and 2, improved control and gas management may be achieved compared to systems in which the gas port 146 is positioned significantly closer to the back end surface 132 of the barrel 102 (in which case the range of pressure differences between various bullets may be relatively greater, and pressure levels experienced through the gas port 146 may be erratic and unpredictable).

Figure 6A:
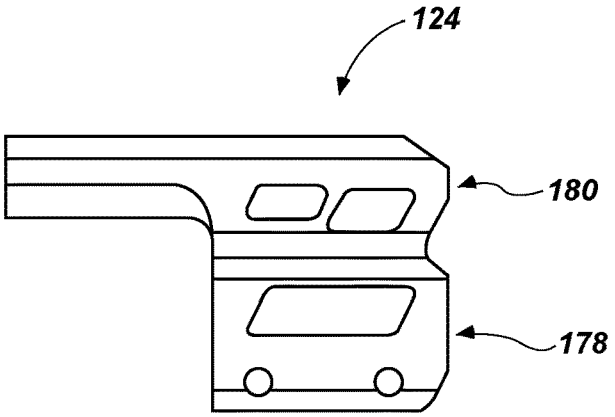
FIG. 6A shows a side view of a gas block of the firearm of FIG. 1 according to an embodiment of the present disclosure.
Figure 6B:
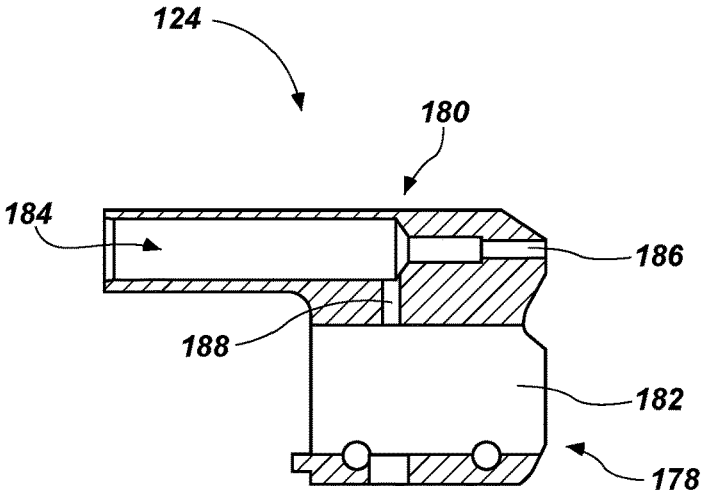
FIG. 6B shows a cross-sectional view of the gas block of FIG. 6A.
Figure 6C:
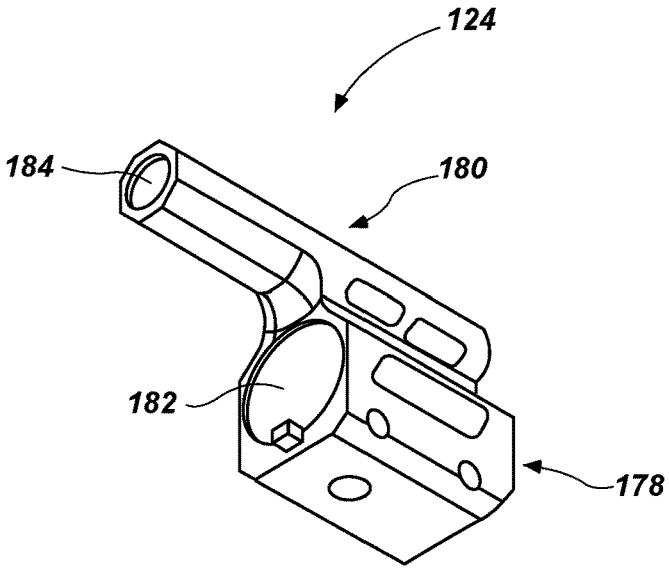
FIG. 6C shows a perspective view of the gas block of FIGS. 6A and 6B.

FIGS. 6A-6C show different views of the gas block 124 of the firearm 100 of FIG. 1 according to an embodiment of the present disclosure. Referring to FIG. 6A, the gas block 124 may include a lower portion 178 for coupling to the barrel 102 (FIGS. 2A and 2B) and an upper portion 180 for slidably coupling to the gas piston 126 (FIG. 1). Referring to FIGS. 6A and 6B, the lower portion 178 may include a cavity 182 complementary to and configured for receiving the barrel 102. The upper portion 180 may include a bore 184 complementary to and configured for receiving at least a portion of the gas piston 126. As can be seen in FIG. 6B, an off gas port 186 may extend from the bore 184 to a front of the upper portion 180 of the gas block 124. The gas block 124 may include a channel 188 sized and configured to be positioned directly over (e.g., substantially aligned with) the gas port 146 of the barrel 102 (FIGS. 2A and 2B) and to provide fluid communication between the gas port 146 (positioned within the cavity 182 when the gas block 124 is assembled to the barrel 102) and the bore 184. The bore 184 may act as a piston chamber in which the gas piston 124 may slide in response to pressurized gas flowing through the channel 188 and into the bore 184.

Figure 7A:
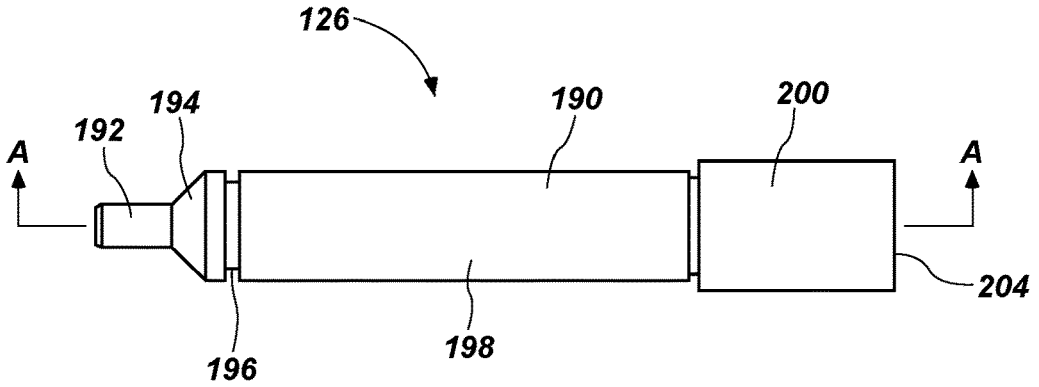
FIG. 7A shows a side view of a gas piston of the firearm of FIG. 1 according to an embodiment of the present disclosure.
Figure 7B:
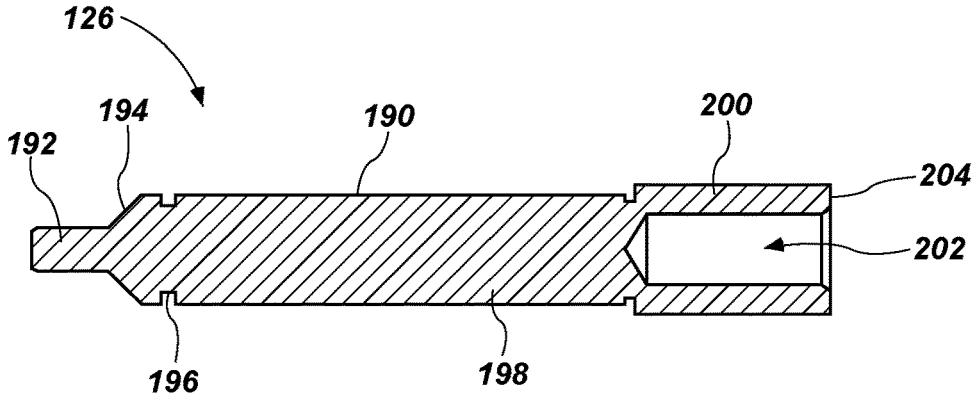
FIG. 7B shows a cross-sectional view of the gas piston of FIG. 7A.
Figure 7C:
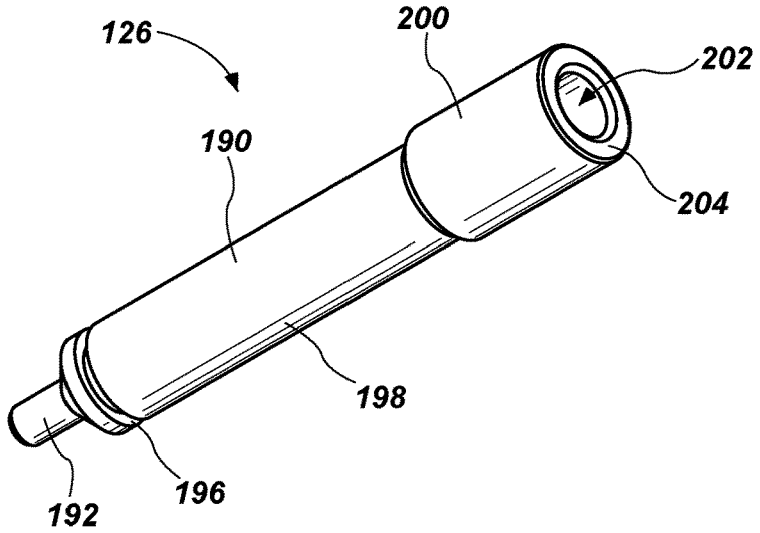
FIG. 7C shows a perspective view of the gas piston of FIGS. 7A and 7B.

FIGS. 7A-7C show various views of the gas piston 126 of the firearm 100 of FIG. 1 according to an embodiment of the present disclosure. The gas piston 126 may include a body 190 including a front extension 192, a beveled portion 194 proximate the front extension 192, a groove 196 around a circumference of the body 190 proximate the beveled portion 194, a central cylindrical portion 198, and a back enlarged portion 200. The groove 196 may be sized and configured for holding a sealing member, such as an O-ring. As shown in FIGS. 7B and 7C, an operation rod cavity 202 may extend into the back enlarged portion 200 from a back end surface 204 of the gas piston 126. The operation rod cavity 202 may be sized and configured for receiving a front end portion of the operation rod 128 (FIG. 1).

Referring to FIGS. 7A-7C in conjunction with FIGS. 6A-6C, the shape and size of the gas piston 126 (e.g., the front extension 193, beveled portion 194, and central cylindrical portion 198) may be substantially complementary to an inner surface of the bore 184 of the gas block 124 for slidable coupling with the gas block 124. The back enlarged portion 200 of the gas piston 126 may be located along the gas piston 126 and sized to be positioned outside of and behind the gas block 124 when the gas piston 126 is in its initial, fully forward position relative to the gas block 124. The shape and size of the front extension 192 may be selected to define a stroke length and time of movement of the gas piston 126 within the gas block 124 upon firing. For example, as pressurized gas is forced into the gas block 124 through the channel 188, the pressurized gas acts on the beveled portion 194 to force the gas piston 126 to move backward. The force induced by the pressurized gas on the beveled portion 194 remains substantially constant until the front extension 192 clears a complementary narrow front portion of the bore 184 in the gas block 124, at which time a portion of the pressurized gas is allowed to exit the bore 184 through the off gas port 186. Accordingly, a length of the front extension 192 directly affects the stroke length and time of the gas piston 126 as it moves in response to pressurized gas. The stroke length and time of the gas piston 126, in turn, directly affects the timing and mechanics of the cycling of the bolt assembly 108 (FIG. 1). By way of example and not limitation, a length of the front extension 192 of the gas piston 126 may be between about 0.140 inch (3.556 mm) and about 0.420 inch (10.668 mm). In one example, the length of the front extension 192 may be about 0.280 inch (7.112 mm).

Figure 8A:
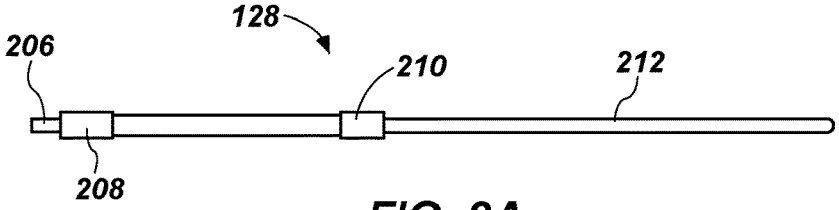
FIG. 8A shows a side view of an operation rod of the firearm of FIG. 1 according to an embodiment of the present disclosure.
Figure 8B:
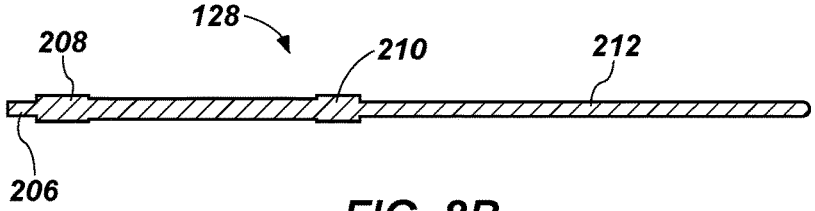
FIG. 8B shows a cross-sectional view of the operation rod of FIG. 8A.
Figure 8C:
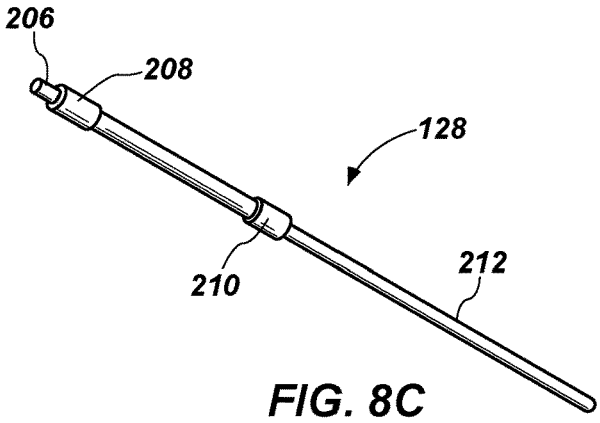
FIG. 8C shows a perspective view of the operation rod of FIGS. 8A and 8B.

FIGS. 8A-8C show various views of the operation rod 128 of the firearm 100 of FIG. 1 according to an embodiment of the present disclosure. The operation rod 128 includes a front rod extension 206 sized and shaped for being received in the operation rod cavity 202 of the gas piston 126 (FIGS. 7B and 7C) and a front enlarged portion 208 against which the back end surface 204 of the gas piston 126 may abut. A central enlarged portion 210 may be provided in the operation rod 128 against which a spring may be seated for biasing the operation rod 128 forward, toward and against the gas piston 126. An elongated back portion 212 of the operation rod 128 may have a length that is selected to be operatively coupled to (e.g., directly or indirectly coupled to, abutting against) the bolt assembly 108 (FIG. 1) for cycling of the bolt assembly 108. An overall length of the operation rod 128 may be selected based at least in part on a selected position of the gas port 146 along the barrel 102, as discussed above in relation to FIGS. 2A and 2B, so that the operation rod 128 may operatively extend between the gas piston 126 and the bolt assembly 108.

In operation (referring to FIGS. 7A-7C and 8A-8C), the short stroke of the gas piston 126 described above may exhibit sufficient energy to force the operation rod 128 to move backward and to provide sufficient kinetic energy to the bolt assembly 108 (FIG. 1) to overcome a spring bias on the bolt assembly 108 and to cycle the bolt assembly 108 through a full stroke of extracting and ejecting a spent case and inserting a new bullet into the firing chamber 148 (FIG. 2B).

Figure 9A:
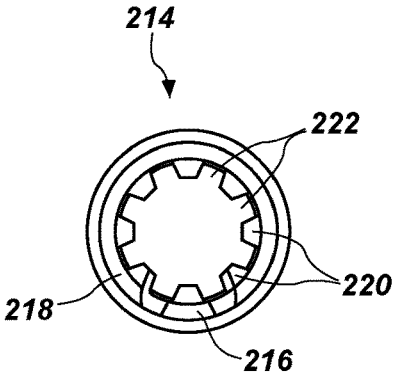
FIG. 9A shows an end view of a barrel extension of the firearm of FIG. 1 according to an embodiment of the present disclosure.
Figure 9B:
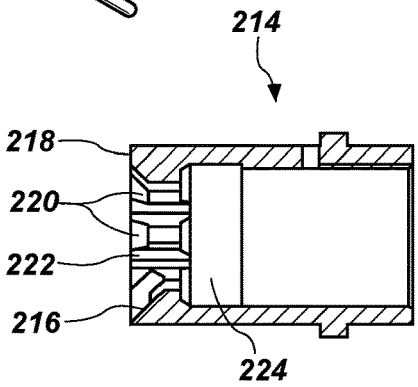
FIG. 9B shows a cross-sectional side view of the barrel extension of FIG. 9A.
Figure 9C:
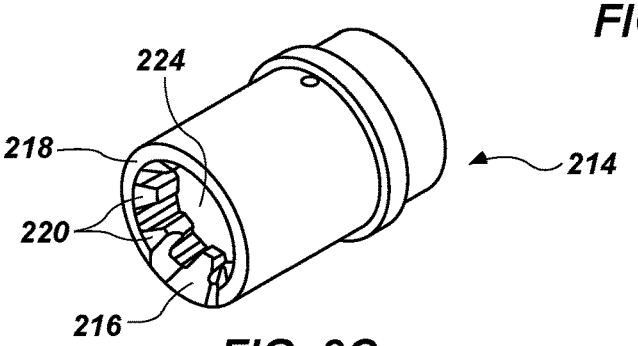
FIG. 9C shows a perspective view of the barrel extension of FIGS. 9A and 9B.
Figure 10A:
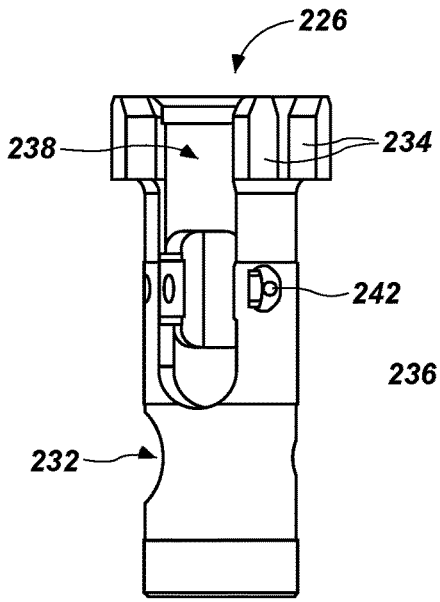
FIG. 10A shows a side view of a bolt of the firearm of FIG. 1 according to an embodiment of the present disclosure.
Figure 10B:
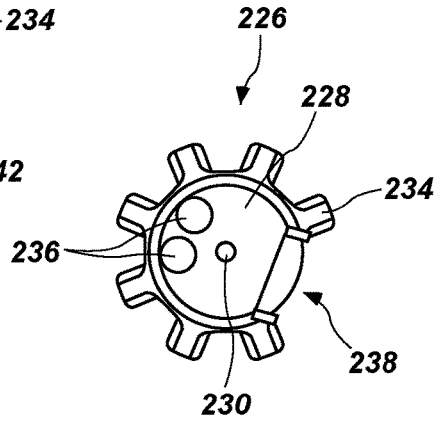
FIG. 10B shows an end view of the bolt of FIG. 10A.
Figure 10C:
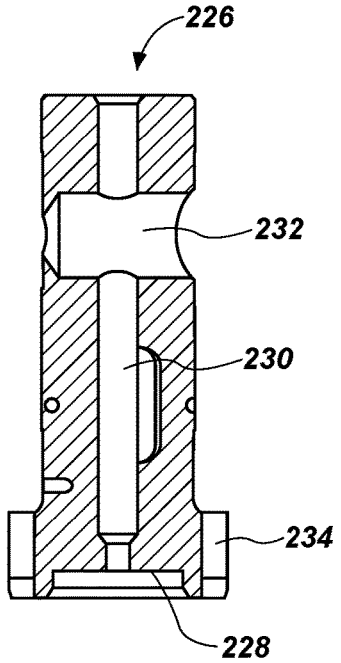
FIG. 10C shows a cross-sectional view of the bolt of FIGS. 10A and 10B.
Figure 10D:
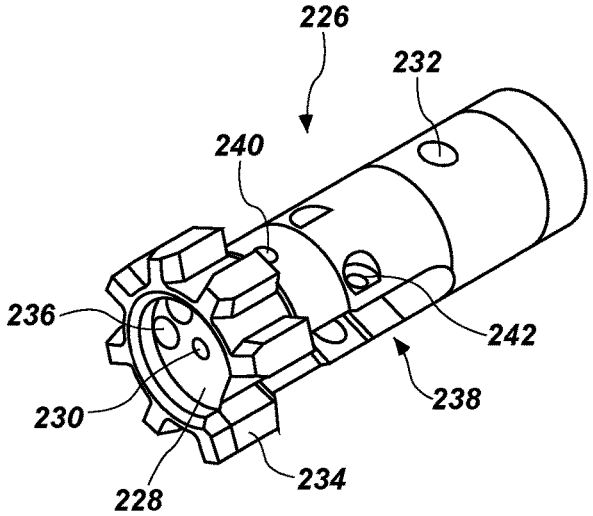
FIG. 10D shows a perspective view of the bolt of FIGS. 10A-10C.

FIGS. 9A-9C show various views of a barrel extension 214 of the firearm 100 of FIG. 1 according to an embodiment of the present disclosure. The barrel extension 214 may be configured for coupling to the back threaded portion 134 of the barrel 102 (FIGS. 2A and 2B).

The barrel extension 214 may include at least one lower feed ramp 216 extending from an outer diameter at a back end surface 218 of the barrel extension 214 at an angle of between about 30 degrees and about 55 degrees. For example, the angle of the at least one lower feed ramp 216 may be about 45 degrees. In some embodiments, as shown in FIGS. 9A-9C, the barrel extension 214 includes only a single feed ramp 216. The single feed ramp 216 may effectively function to load bullets into the firing chamber 148 (FIG. 2B) from a single feed magazine or from a dual feed magazine.

The barrel extension 214 may include internal locking lugs 220 extending radially into an interior of the barrel extension 214 proximate the back end surface 218. In some embodiments, the barrel extension 214 may include eight internal locking lugs 220 substantially equally circumferentially spaced from each other and separated by gaps 222. The single feed ramp 216 may be a surface that extends laterally across one lower internal locking lug 220, across the gaps 222 flanking the lower internal locking lug 220, and across a portion (e.g., about half) of the two internal locking lugs 220 on both sides of the lower internal locking lug 220. A bolt lock cavity 224 may be located in front of the internal locking lugs 220.

FIGS. 10A-10D show various views of a bolt 226 of the firearm 100 of FIG. 1 according to an embodiment of the present disclosure. The bolt 226 may include a front surface 228, a firing pin bore 230 extending longitudinally through the bolt 226, a cam pin cavity 232 extending laterally at least partially across the bolt 226, and locking lugs 234 extending radially outward proximate the front surface 228. For example, the bolt 226 may include seven locking lugs 234, with an additional locking lug to be provided by an extractor (described below) to be coupled to the bolt 226. At least one (two shown) ejector pin cavity 236 extends longitudinally back from the front surface 228 into a body of the bolt 226. A case extractor recess 238 extends from the front surface 228 of the bolt 226 along a side of the bolt 226 for receiving a case extractor. An ejector lock pin hole 240 is positioned and configured for receiving an ejector lock pin for locking ejectors (described below) in place. A pivot hole 242 is configured and located to receive an extractor pivot pin, to provide a pivot point for an extractor (described below).

Figure 11A:
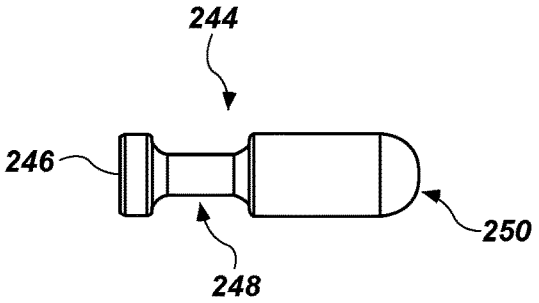
FIG. 11A shows a side view of an ejector pin of the firearm of FIG. 1 according to an embodiment of the present disclosure.
Figure 11B:
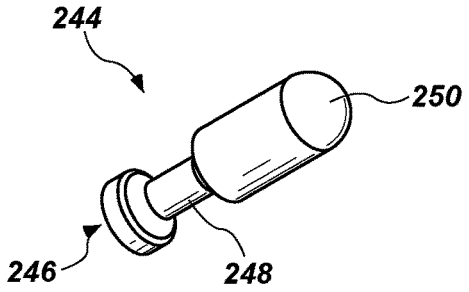
FIG. 11B shows a perspective view of the ejector pin of FIG. 11A.
Figure 12A:
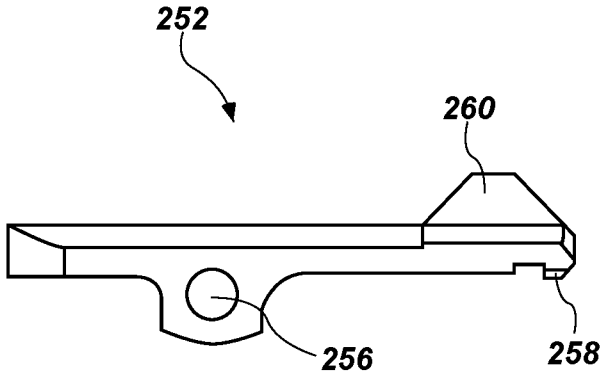
FIG. 12A shows a side view of a case extractor of the firearm of FIG. 1 according to an embodiment of the present disclosure.
Figure 12B:
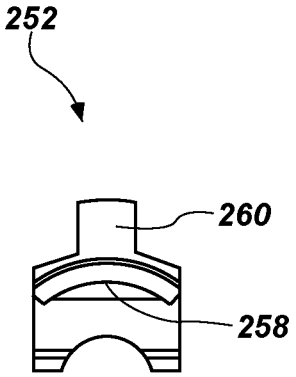
FIG. 12B shows an end view of the case extractor of FIG. 12A.
Figure 12C:
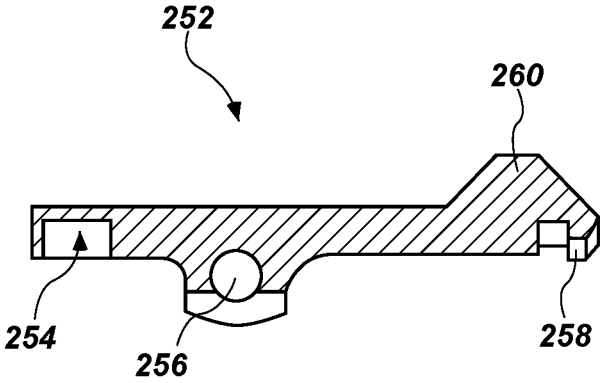
FIG. 12C shows a cross-sectional view of the case extractor of FIGS. 12A and 12B.
Figure 12D:
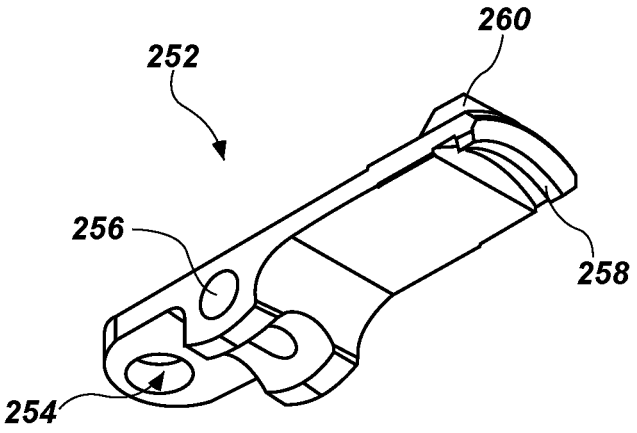
FIG. 12D shows a perspective view of the case extractor of FIGS. 12A-12C.

FIGS. 11A and 11B show two views of an ejector pin 244 of the firearm 100 of FIG. 1 according to an embodiment of the present disclosure. The ejector pin 244 may be sized to at least partially fit within a respective ejector pin cavity 236 of the bolt 226 (FIGS. 11A-11D). The ejector pin 244 may include a substantially flat back end 246, a necked portion 248, and a rounded ejector end 250. The necked portion 248 may be provided to enable an ejector lock pin to pass alongside the necked portion 248 to maintain the ejector pin 244 within the ejector pin cavity 236 (FIGS. 11A-11D). The necked portion 248 may be a centrally located portion of the ejector pin 244 that has a narrower diameter compared to other portions of the ejector pin 244. Thus, the ejector pin 244 may be oriented at any rotational position, and still be retained in place by an ejector lock pin. The rounded ejector end 250 may be, for example, substantially hemispherical. The rounded ejector end 250 may be configured to push against a spent bullet case to force the case to rotate and be ejected out of the firearm 100. The rounded (e.g., substantially hemispherical) shape of the rounded ejector end 250 may inhibit (e.g., reduce or eliminate) damage to the case resulting from the ejector pin 244 pushing against the bullet case, to increase a potential for reuse of the case.

FIGS. 12A-12D show various views of a case extractor 252 of the firearm 100 of FIG. 1 according to an embodiment of the present disclosure. The case extractor 252 may be shaped and configured to be coupled to the bolt 226 at least partially within the case extractor recess 238 (FIGS. 10A-10D). The case extractor 252 may include a spring cavity 254 proximate a back end thereof and a pivot pin hole 256 about which the case extractor 252 may pivot in operation. A curved extractor lip 258 may be located proximate a front end of the case extractor 252 and on an inner side of the case extractor 252, the curved extractor lip 258 being shaped and configured to engage a rim of a spent bullet case to extract the bullet case upon withdrawal of the bolt 226. An extractor locking lug 260 may be positioned on an outer side of the case extractor 252 proximate the front end thereof. The extractor locking lug 260 and the locking lugs 234 of the bolt 226 (FIGS. 10A-10D) may provide a total of eight locking lugs 234, 260 to the bolt assembly 108 (FIG. 1).

The curved extractor lip 258 of the case extractor 252 may be in the shape of an arc of a circle. The arc of the curved extractor lip 258 may have a central arc angle of at least about 50 degrees to engage a rim of a bullet case by at least about 14% of the bullet case's circumference. By way of example and not limitation, the central arc angle of the curved extractor lip 258 may be between about 50 degrees and about 85 degrees, such as about 72 degrees (i.e., 20% of the bullet case's circumference). The curved extractor lip 258 of the described size and configuration may enable more reliable case extraction than with prior known extractors by engaging the rim of the bullet case along an increased portion of its circumference. The case extractor 252 of the present disclosure may be particularly effective and useful for extracting large bullet cases, such as those used with .338 (e.g., LAPUA® Magnum) caliber bullets, .308 caliber bullets, and .50 caliber bullets.

The bolt 226 (FIGS. 10A-10D), at least one ejector pin 244 (FIGS. 11A and 11B), and case extractor 252 (FIGS. 12A-12C) may be assembled together and positioned within a bolt carrier along with a firing pin, as is known in the art, to define the bolt assembly 108 (FIG. 1).

Figure 13A:
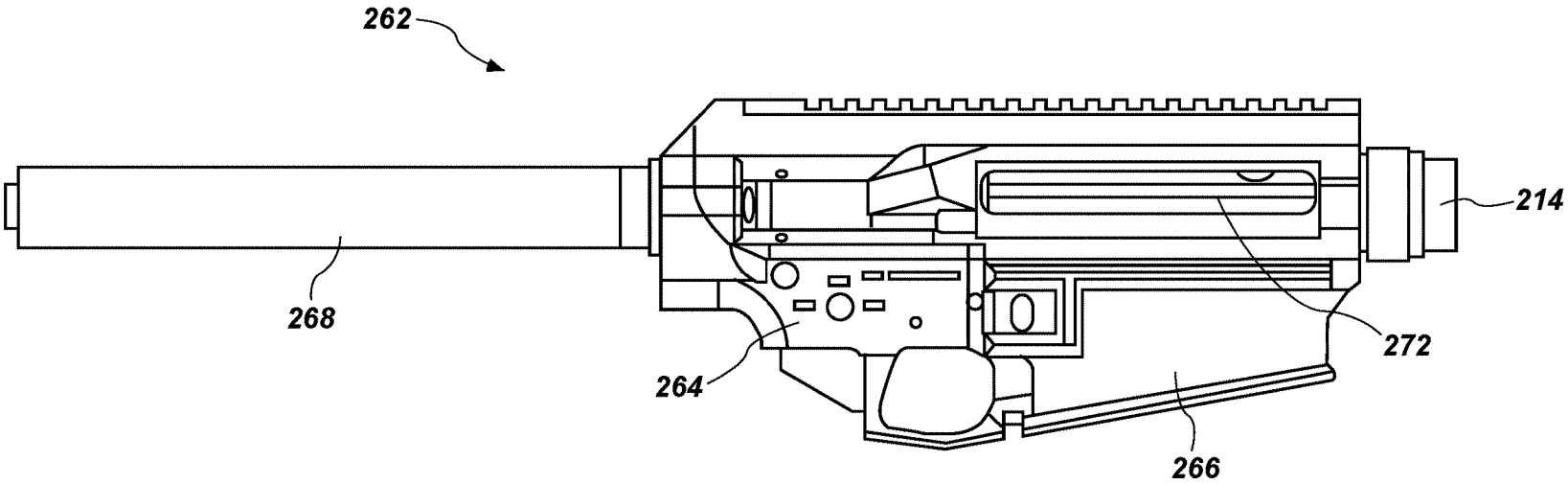
FIG. 13A shows a side view of a back end assembly of the firearm of FIG. 1 according to an embodiment of the present disclosure.
Figure 13B:
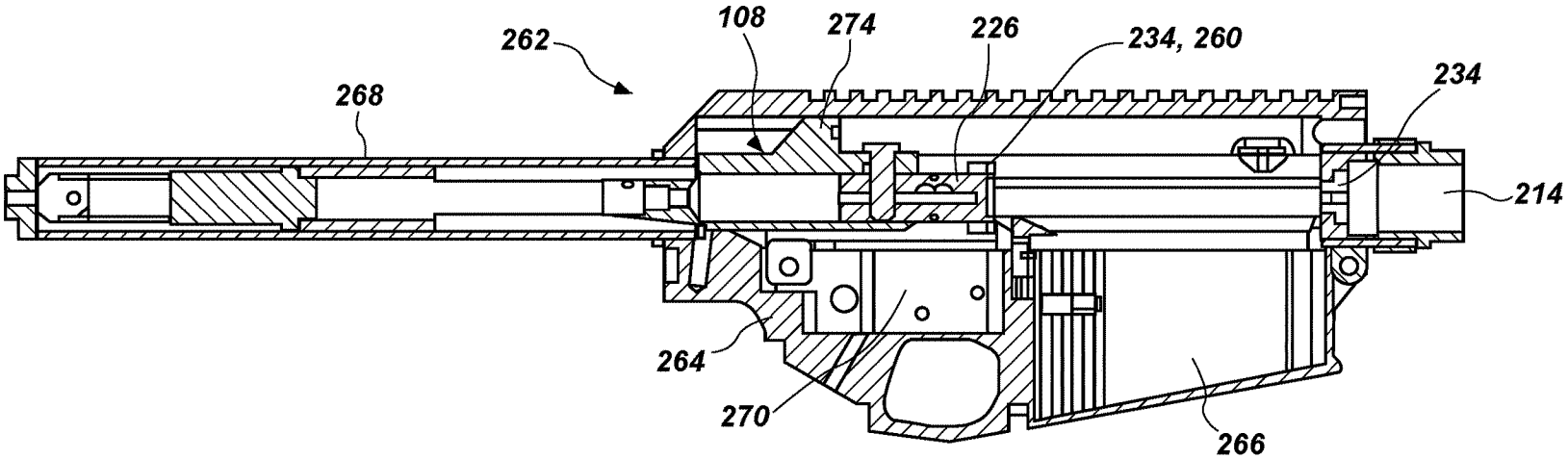
FIG. 13B shows a cross-sectional view of the receiver and buffer tube assembly of FIG. 13A, with a bolt in a retracted position.

FIGS. 13A and 13B show two views of a receiver and buffer tube assembly 262 of the firearm 100 of FIG. 1 according to an embodiment of the present disclosure. The receiver and buffer tube assembly 262 may include a receiver body 264, a magazine holder 266 coupled to (or, alternatively, an integral part of) the receiver body 264, a receiver extension 268 coupled to a back portion of the receiver body 264, the bolt assembly 108 installed in the receiver body 264, and the barrel extension 214 coupled to a front portion of the receiver body 264. The receiver body 264 may include a trigger assembly cavity 270 for housing a trigger assembly, and an ejection port 272 through which spent bullet cases may be ejected. The bolt assembly 108 may include the bolt 226, at least one ejector pin 244 (FIGS. 11A and 11B), case extractor 252 (FIGS. 12A-12C), and a bolt carrier 274.

In operation, the bolt assembly 108 may be positioned in the back position shown in FIG. 13B and a bullet may be positioned in front of the bolt 226. The bolt assembly 108 may be pushed forward to load the bullet into and partially through the barrel extension 214. As the bolt assembly 108 is pushed forward, the locking lugs 234 of the bolt 226 and the extractor locking lug 260 may pass between and into a chamber in front of the internal locking lugs 220 of the barrel extension 214. The bolt 226 may rotate to position the locking lugs 234 and extractor locking lug 260 directly in front of the internal locking lugs 220 of the barrel extension 214. A firing pin (not shown) extending through the bolt 226 may strike the bullet, causing the bullet to fire. Firing of the bullet may result in pressure passing through the gas block 124 (FIGS. 1 and 6A-6C) to force the gas piston 126 (FIGS. 1 and 7A-7C) and operation rod 128 backward, which may also force the bolt carrier 274 backward. The bolt 226 may rotate to position the locking lugs 234 and extractor locking lug 260 between the internal locking lugs 220 of the barrel extension 214, allowing the bolt 226 to slide backward, and the bolt assembly 108 to continue sliding backward. The curved extractor lip 258 of the case extractor 252 (FIGS. 12A-12D) may engage a rim of the spent bullet case to pull the case out of the barrel extension 214. As the case clears the barrel extension 214, the at least one ejector pin 244 (FIGS. 11A and 11B) of the bolt assembly 108 may push against the bullet case to rotate the bullet case out of the ejection port 272 of the receiver body 264.

In some embodiments, the ejection port 272 may have a length sufficient to enable the spent bullet case to be ejected therethrough without reaching a back end of the ejection port 272. In other words, when the bolt assembly 108 is in the back position shown in FIG. 13B, a front end of the bolt 226 may be positioned substantially longitudinally even with or forward of the back end of the ejection port 272. For example, the back end of the ejection port 272 may be positioned between about 0 inch and about 0.25 inch (6.35 mm; e.g., about 0.1 inch (2.54 mm)) behind the front end of the bolt 226 when the bolt assembly 108 is in its backmost position. A front end longitudinal end of the ejection port 272 may be substantially aligned with a back of the barrel extension 214. By way of example and not limitation, the ejection port 272 may have a length of about 4.9 inches (12.446 cm), and a distance between a back of the barrel extension 214 and a front end of the bolt 226 when the bolt assembly 108 is in its backmost position may be about 4.8 inches (12.192 cm). The act of stopping the bolt assembly 108 in its backmost position may be referred to as "dead blow." When dead blow occurs, kinetic energy of the bolt assembly 108 may be transferred to the receiver and buffer tube assembly 262. By positioning the front end of the bolt 226 substantially longitudinally even with or forward of the back end of the ejection port 272 when dead blow occurs, a portion of the kinetic energy of the bolt assembly 108 may instead be transferred to the spent bullet case to assist in ejection of the bullet case, which may also reduce the amount of kinetic energy transferred to the receiver and buffer tube assembly 262. In addition, positioning the front end of the bolt 226 substantially longitudinally even with or forward of the back end of the ejection port 272 when dead blow occurs may reduce damage to the spent bullet case that may otherwise occur if the bullet case were allowed to contact the edge of the ejection port 272 (e.g., as might occur if the back end of the ejection port 272 were in front of the front end of the bolt 226 at dead blow).

Figure 14A:
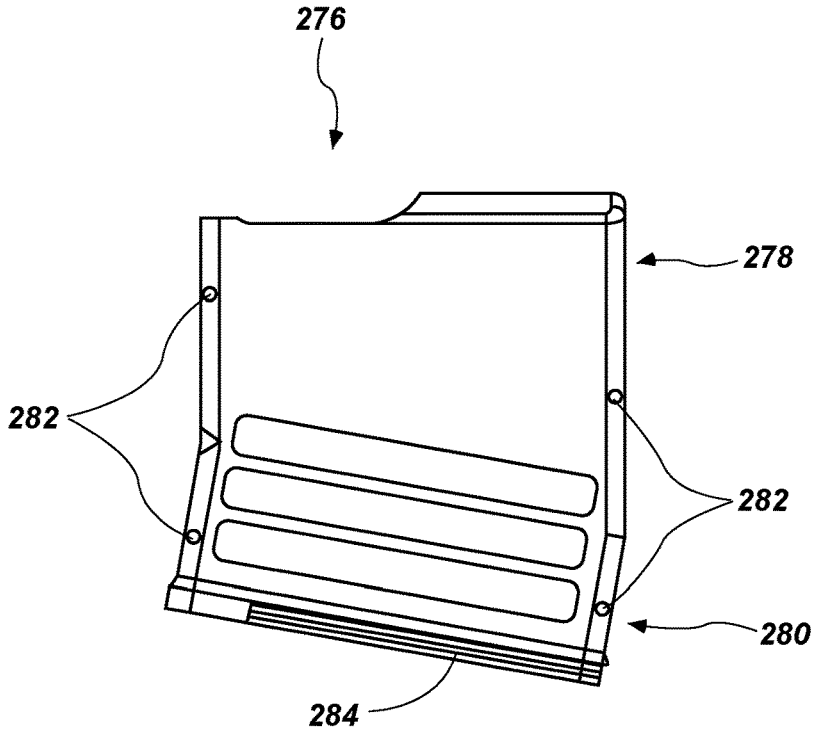
FIG. 14A shows an outside view of a first magazine side wall of the firearm of FIG. 1 according to an embodiment of the present disclosure.
Figure 14B:
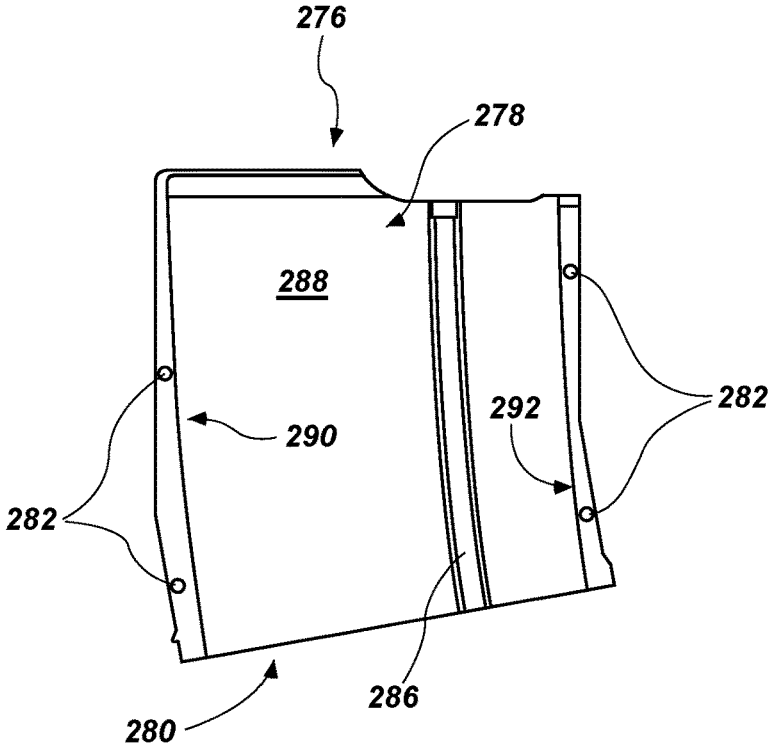
FIG. 14B shows an inside view of the first magazine side wall of FIG. 14A.

FIGS. 14A and 14B show side views of a first magazine side wall 276 of the magazine 112 of the firearm 100 of FIG. 1 according to an embodiment of the present disclosure. The first magazine side wall 276 may include an upper end portion 278 and a lower end portion 280 that is angled relative to the upper end portion 278. For example, the lower end portion 280 may be angled forward from the upper end portion 278 at an angle of between about 5 degrees and about 15 degrees, such as about 10 degrees. Holes 282 along sides of the first magazine side wall 276 and a groove 284 along an edge of the lower end portion 280 may be provided for assembly. The holes 282 of the first magazine side wall 276 may be through-holes for passing a screw, bolt, or other fastener therethrough. As shown in FIG. 14B, a protrusion 286 may extend from an inner surface 288 of the first magazine side wall 276. The protrusion 286 may be positioned to be adjacent to shoulders of respective bullets loaded in the magazine 112 (FIG. 1), to maintain proper alignment and orientation of the bullets within the magazine 112. The protrusion 286 may be curved from the upper end portion 278 to the lower end portion 280 of the first magazine side wall 276. Similarly, a front inner edge 290 and a back inner edge 292 of the first magazine side wall 276 may also be curved. To accommodate a shape and size of bullets (e.g., having a larger diameter at a base and a smaller diameter at a tip) to be used with the magazine 112, the front inner edge 290 may be shorter in length than the back inner edge 293.

Figure 15A:
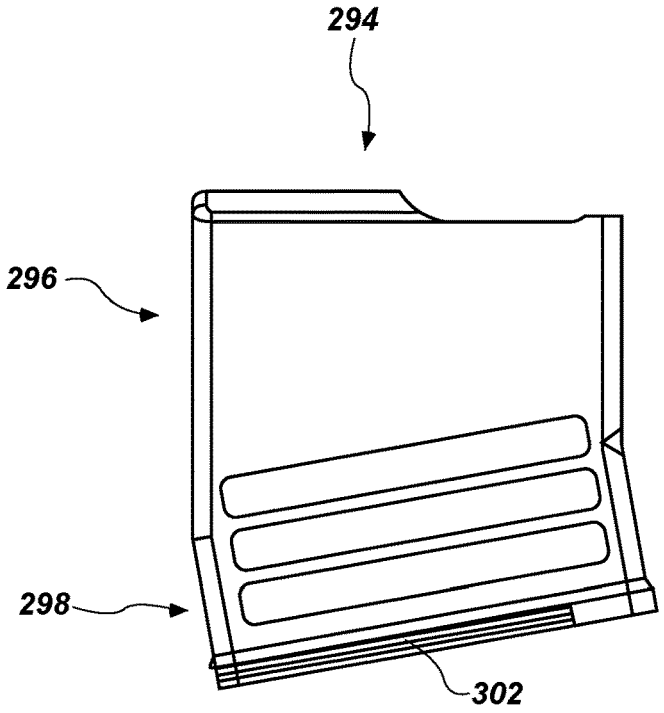
FIG. 15A shows an outside view of a second magazine side wall of the firearm of FIG. 1 according to an embodiment of the present disclosure.
Figure 15B:
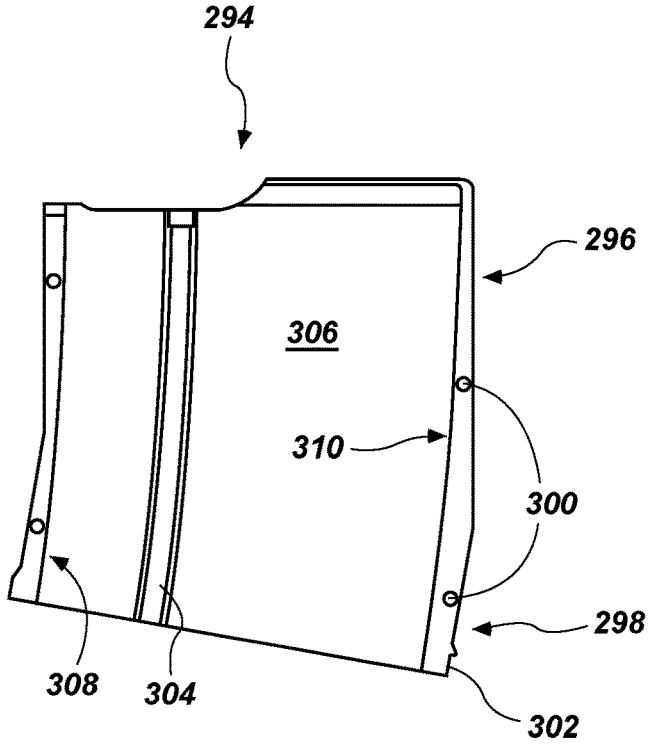
FIG. 15B shows an inside view of the second magazine side wall of FIG. 15A.

FIGS. 15A and 15B show side views of a second magazine side wall 294 of the magazine 112 of the firearm 100 of FIG. 1 according to an embodiment of the present disclosure. The second magazine side wall 294 may be similar to and complementary to the first magazine side wall 276 (FIGS. 14A and 14B) for assembly with the first magazine side wall 276. For example, the second magazine side wall 294 may include an upper end portion 296, a lower end portion 298, holes 300 positioned for alignment with the holes 282 of the first magazine side wall 276, and a groove 302 along an edge of the lower end portion 296 provided for assembly. The lower end portion 296 of the second magazine side wall 292 may be angled forward from the upper end portion 294 at an angle of between about 5 degrees and about 15 degrees, such as about 10 degrees. In some embodiments, the holes 300 of the second magazine side wall 294 may be blind holes for receiving an end of a screw, bolt, or other fastener therein. As shown in FIG. 15B, a protrusion 304 may extend from an inner surface 306 of the second magazine side wall 294, and may be curved and positioned as explained above with respect to the protrusion 286 of the first magazine side wall 276. A front inner edge 308 and a back inner edge 310 of the second magazine side wall 294 may be curved. The front inner edge 308 may be shorter than the back inner edge 310 of the second magazine side wall 294.

Figure 16:
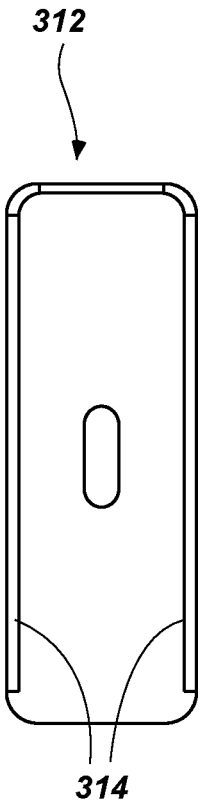
FIG. 16 shows a bottom view of a magazine bottom wall of the firearm of FIG. 1 according to an embodiment of the present disclosure.

FIG. 16 shows a top plan view of a magazine bottom wall 312 of the magazine 112 of the firearm 100 of FIG. 1 according to an embodiment of the present disclosure. The magazine bottom wall 312 may be sized and configured for coupling to the lower end portion 280 of the first magazine side wall 276 and to the lower end portion 298 of the second magazine side wall 294. For example, the magazine bottom wall 312 may include at least one inner projection 314 for sliding into the respective grooves 284, 302 of the first magazine side wall 276 and second magazine side wall 294. One longitudinal end of the magazine bottom wall 312 may be free of any inner projection 314, to enable the remaining at least one inner projection 314 to slide into the respective grooves 284, 302. The magazine bottom wall 312 may provide a surface against which a spring may be compressed as bullets are loaded into the magazine 112 (FIG. 1).

The magazine 112 (FIG. 1) may be formed by assembling the first magazine side wall 276 (FIGS. 14A and 14B) to the second magazine side wall 294 (FIGS. 15A and 15B) (e.g., fastening using the holes 282, 300), and coupling the magazine bottom wall 312 (FIG. 16) onto the assembled first and second magazine side walls 276, 294 (e.g., using the grooves 284, 302 and at least one inner projection 314). The magazine 112 may be sized and configured as a dual feed detachable box magazine. Thus, the magazine 112 may be configured to hold bullets in two side-by-side staggered stacks for compact storage of the bullets. By way of example and not limitation, the magazine 112 may hold up to ten bullets. The magazine 112 may be a dual feed magazine 112 for large caliber bullets, such as .338 LAPUA® Magnum bullets, .300 WINCHESTER® Magnum bullets, or .50 BMG bullets, for example.

The magazine 112 (FIG. 1) may be configured to provide bullets into the barrel 102 (FIGS. 1, 2A, and 2B) using the lower feed ramp 216 of the barrel extension 214 (FIGS. 6A-6C). The angle of the bullets provided into the barrel 102 using the lower feed ramp 216 may be configured such that the cases of the bullets hit against the lower feed ramp 216 without the projectiles of the bullets hitting against the lower feed ramp 216, to inhibit (e.g., reduce or eliminate) damage to the projectiles.

The embodiments of the disclosure described above and illustrated in the accompanying drawing figures do not limit the scope of the invention, since these embodiments are merely examples of embodiments of the disclosure. The invention is encompassed by the appended claims and their legal equivalents. Any equivalent embodiments lie within the scope of this disclosure. Indeed, various modifications of the present disclosure, in addition to those shown and described herein, such as other combinations and modifications of the elements described, will become apparent to those of ordinary skill in the art from the description. Such embodiments, combinations, and modifications also fall within the scope of the appended claims and their legal equivalents.

What is claimed is:

1. A firearm, comprising:

a receiver;

a bolt assembly within the receiver;

a barrel having a back end coupled to the receiver, a front end, and a wall, a length x of the barrel from the back end to the front end being between about 14 inches (35.56 cm) and about 18 inches (45.72 cm); and a gas management system, comprising:

a gas port extending through the wall of the barrel, the gas port being located a distance y from the back end of the barrel defined by an equation $y=3.135*x^{0.4841}\pm1.0$ and having a dwell time v defined by an equation $v=12.561*\ln(x)-30.826\pm1.0$ in order to allow a sufficient fluid pressure through the gas port during operation of the firearm;

a gas block coupled to the barrel and in fluid communication with the gas port;

a gas piston slidably coupled to the gas block and configured to move backward toward the receiver responsive to the sufficient fluid pressure being applied to the gas block through the gas port; and an operation rod coupled to the gas piston and configured to force the bolt assembly in a backward direction responsive to the gas piston moving backward toward the receiver.

2. The firearm of claim 1, wherein when the gas port is located the distance y from the back end of the barrel to reduce movement of the barrel during operation of the firearm.

3. The firearm of claim 1, further comprising:

a dual feed magazine configured to hold bullets of at least .300 caliber, wherein the barrel is positioned to receive the bullets from the dual feed magazine; and a single feed ramp positioned to direct the bullets from the dual feed magazine into the barrel.

4. The firearm of claim 3, further comprising a barrel extension coupled to the barrel, wherein the barrel extension comprises the single feed ramp.

5. The firearm of claim 4, wherein the single feed ramp has an angle of about 45 degrees from a length of the barrel extension.

6. The firearm of claim 1, further comprising an ejector pin for ejecting spent bullet cases, the ejector pin coupled to the bolt assembly and comprising a convex rounded ejector end configured to press against a spent bullet case to eject the spent bullet case from the firearm.

7. The firearm of claim 6, wherein the convex rounded ejector end is substantially hemispherical.

8. The firearm of claim 6, wherein the ejector pin comprises a necked portion of reduced diameter for retaining the ejector pin in place by an ejector lock pin.

9. The firearm of claim 1, further comprising a case extractor for extracting spent bullet cases, the case extractor comprising a curved extractor lip having a central arc angle of between about 50 degrees and about 85 degrees.

10. The firearm of claim 9, wherein the central arc angle of the curved extractor lip is about 72 degrees.

11. The firearm of claim 1, wherein:

the receiver includes an ejection port configured for ejection of spent bullet casings; and the bolt assembly comprises a bolt with a front end and a case extractor, wherein a back end of the ejection port is positioned to be longitudinally even with or behind the front end of the bolt as the bolt assembly reaches its backmost position during a cycling operation.

12. The firearm of claim 11, wherein the ejection port is at least 0.1 inch (0.254 cm) longer than a distance between the front end of the bolt and a bullet feed ramp when the bolt assembly reaches its backmost position during a cycling operation.

13. A method of forming a firearm, comprising:

locating a gas port in a barrel having a length x a distance y from a back end of the barrel to provide sufficient dwell time v for actuating a gas management system defined by equations $y=3.135*x^{0.4841}\pm1.0$ and $v=12.561*\ln(x)-30.826\pm1.0$;

coupling a gas block to the barrel and in fluid communication with the gas port;

slidably coupling a gas piston to the gas block to move responsive to sufficient pressure applied through the gas port; and coupling an operation rod to the gas piston and positioning the operation rod to abut against a bolt assembly responsive to movement of the gas piston.

14. The method of claim 13, wherein locating the gas port a distance y from the back end of the barrel reduces movement of the barrel.

15. The method of claim 13, further comprising coupling a barrel extension including a single feed ramp to the back end of the barrel.

16. The method of claim 13, further comprising:

coupling the barrel to a receiver and buffer tube assembly; and coupling a dual feed magazine to the receiver and buffer tube assembly, the dual feed magazine sized and configured to hold bullets of at least .300 caliber in two side-by-side stacks.

17. The method of claim 13, further comprising coupling a case extractor to the bolt assembly, the case extractor including a curved extractor lip having a central arc angle of between about 50 degrees and about 85 degrees.

18. The method of claim 13, further comprising coupling an ejector pin for ejecting spent bullet cases to the bolt assembly, the ejector pin comprising a convex rounded ejector end configured to press against a spent bullet case to eject the spent bullet case from the firearm.

19. The method of claim 18, wherein the convex rounded ejector end comprises a substantially hemispherical ejector end.

20. The method of claim 13, further comprising positioning a back end of an ejection port through which spent bullet cases are ejected to be between about 0 mm and about 6.35 mm behind a front end of the bolt assembly when the bolt assembly is in its backmost position during a cycling operation.

* * * * *